US008552918B2

(12) United States Patent
Lee et al.

(10) Patent No.: US 8,552,918 B2
(45) Date of Patent: Oct. 8, 2013

(54) MULTIBAND HIGH GAIN OMNIDIRECTIONAL ANTENNAS

(75) Inventors: Ting Hee Lee, Penang (MY); Shanmuganathan Suganthan, San Jose, CA (US)

(73) Assignee: Laird Technologies, Inc., Earth City, MO (US)

( * ) Notice: Subject to any disclaimer, the term of this patent is extended or adjusted under 35 U.S.C. 154(b) by 380 days.

(21) Appl. No.: 13/113,756

(22) Filed: May 23, 2011

(65) Prior Publication Data

US 2011/0221648 A1 Sep. 15, 2011

Related U.S. Application Data

(63) Continuation-in-part of application No. PCT/US2009/066786, filed on Dec. 4, 2009.

(51) Int. Cl.
*H01Q 21/00* (2006.01)

(52) U.S. Cl.
USPC ..... 343/826; 343/702

(58) Field of Classification Search
USPC ..... 235/826, 702, 731, 741, 744, 825, 235/828, 895
See application file for complete search history.

(56) References Cited

U.S. PATENT DOCUMENTS

| | | | | |
|---|---|---|---|---|
| 6,188,364 | B1 * | 2/2001 | Scordilis | 343/702 |
| 7,486,241 | B2 * | 2/2009 | Qi et al. | 343/702 |
| 7,936,308 | B2 * | 5/2011 | Qi et al. | 343/702 |
| 2008/0129623 | A1 * | 6/2008 | Barry | 343/741 |
| 2010/0123642 | A1 * | 5/2010 | Sanz et al. | 343/893 |
| 2011/0156968 | A1 * | 6/2011 | Qi et al. | 343/702 |

* cited by examiner

*Primary Examiner* — Thien M Le
(74) *Attorney, Agent, or Firm* — Harness, Dickey & Pierce, P.L.C.

(57) ABSTRACT

Exemplary embodiments are provided of multiband high gain omnidirectional antennas. In one exemplary embodiment, an antenna generally includes first and second radiating elements. The first radiating element is configured to produce a first radiation pattern at a first operating frequency. The second radiating element is configured to produce a second radiation pattern at a second operating frequency. Each of the first and second radiating elements includes a meandering or helical portion.

22 Claims, 8 Drawing Sheets

| Data Point | GHz | VSWR |
|---|---|---|
| 1 | 2.4000000 | 1.2945 |
| 2 | 2.4500000 | 1.5009 |
| 3 | 2.5000000 | 1.8121 |
| 4 | 4.9000000 | 1.5333 |
| 5 | 5.8750000 | 1.1402 |

MULTIBAND HIGH GAIN OMNIDIRECTIONAL ANTENNAS

CROSS-REFERENCE TO RELATED APPLICATIONS

This application is continuation-in-part of PCT International Application PCT/US2009/066786 filed Dec. 4, 2009 (now published as WO 2010/077574) which, in turn, claims priority to Malaysian Patent Application No. PI 20090004 filed Jan. 2, 2009. The entire disclosures of the above applications are incorporated herein by reference.

FIELD

The present disclosure relates to multiband high gain omnidirectional antennas.

BACKGROUND

This section provides background information related to the present disclosure which is not necessarily prior art.

Omnidirectional antennas are useful for a variety of wireless communication devices because the radiation pattern allows for good transmission and reception from a mobile unit. Sometimes, printed circuit board omnidirectional antennas are used. Generally, an omnidirectional antenna is an antenna that radiates power generally uniformly in one plane with a directive pattern shape in a perpendicular plane, where the pattern is often described as "donut shaped."

SUMMARY

This section provides a general summary of the disclosure, and is not a comprehensive disclosure of its full scope or all of its features.

According to various aspects, exemplary embodiments are provided of multiband high gain omnidirectional antennas. In one exemplary embodiment, an antenna generally includes a first radiating element and a second radiating element. The first radiating element is configured to produce a first radiation pattern at a first operating frequency. The second radiating element is configured to produce a second radiation pattern at a second operating frequency. Each of the first and second radiating elements includes a meandering or helical portion. The meandering or helical portion may be disposed generally between straight portions of a radiating element. A connecting element may connect the first and second radiating elements.

In another exemplary embodiment, a multiband high gain omnidirectional antenna generally includes a first radiating element operable for producing a first radiation pattern at a first operating frequency. The first radiating element includes at least one meandering portion disposed between a $\lambda/4$ radiating portion and a $\lambda/2$ radiating portion, where $\lambda$ is a wavelength of a first signal at the first operating frequency. The antenna also includes a second radiating element operable for producing a second radiation pattern at a second operating frequency. The second radiating element includes at least one meandering portion disposed between a $\lambda/4$ radiating portion and a $\lambda/2$ radiating portion, where $\lambda$ is a wavelength of a second signal at the second operating frequency.

An additional exemplary embodiment of a multiband high gain omnidirectional antenna generally includes first and second radiating elements comprising electrically-conductive wire. The first radiating element is operable for producing a first radiation pattern at a first operating frequency. The first radiating element includes at least one helical portion disposed between a $\lambda/4$ radiating portion and a $\lambda/2$ radiating portion, where $\lambda$ is a wavelength of a first signal at the first operating frequency. The second radiating element is operable for producing a second radiation pattern at a second operating frequency. The second radiating element includes at least one helical portion disposed between a $\lambda/4$ radiating portion and a $\lambda/2$ radiating portion, where $\lambda$ is a wavelength of a second signal at the second operating frequency. A connecting element connects to the $\lambda/4$ radiating portions of the first and second radiating elements. The first and second radiating elements are laterally spaced apart and extend generally perpendicular in a same direction from the connecting element. Further areas of applicability will become apparent from the description provided herein. It should be understood that the description and specific examples are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure in any way.

Figure 1A:
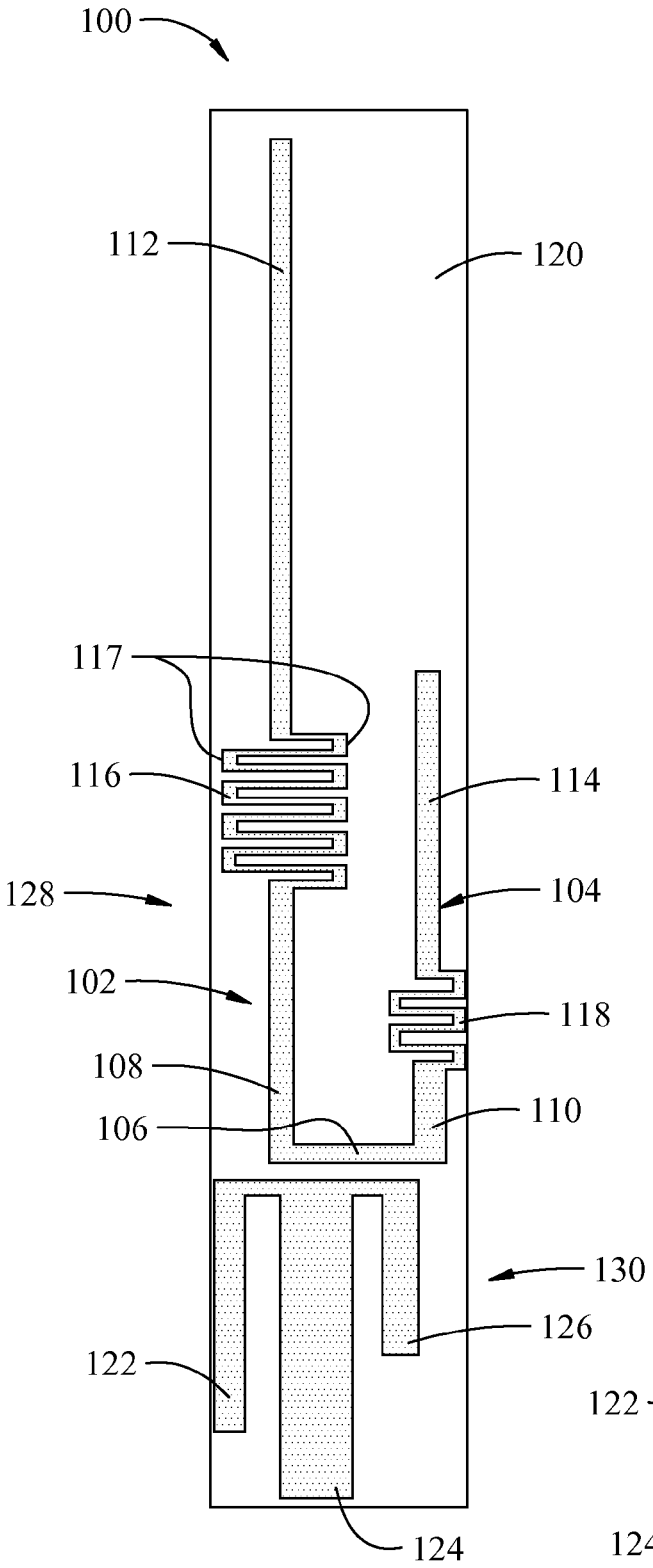
FIG. 1A is a view of a multiband high gain omnidirectional printed circuit board antenna, according to an exemplary embodiment of the present disclosure.
Figure 1B:
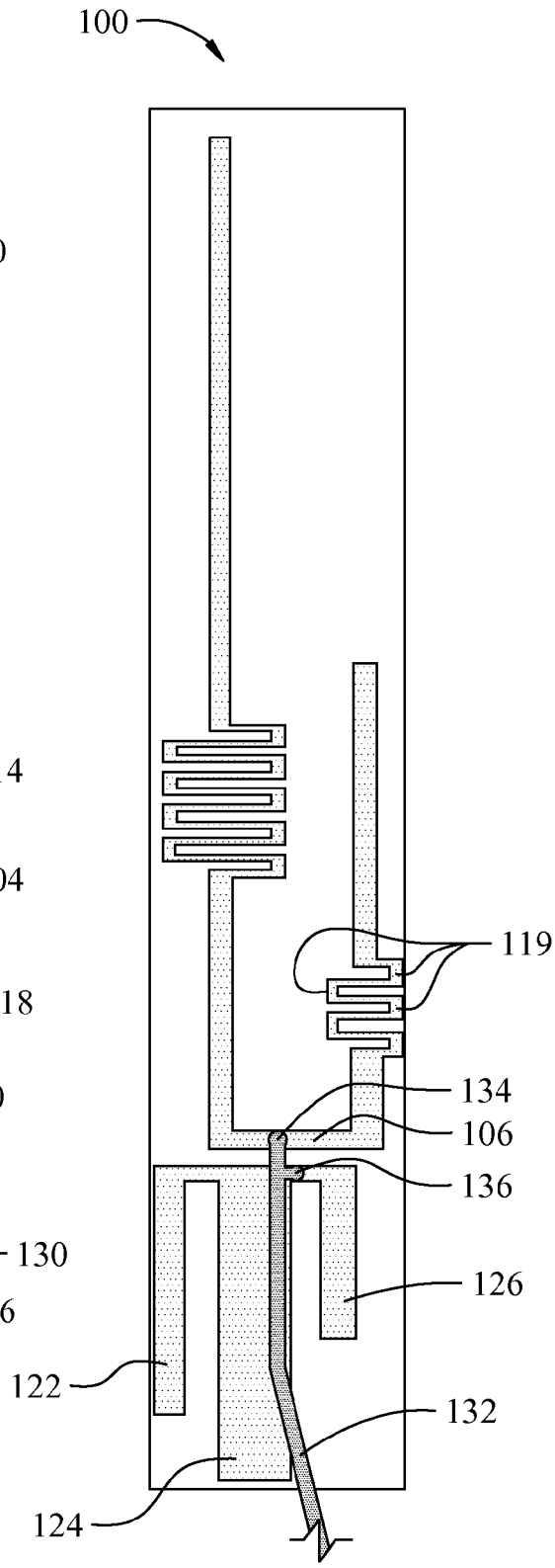
FIG. 1B is a view of a multiband high gain omnidirectional printed circuit board antenna with a coaxial cable conductor attached thereto, according to an exemplary embodiment of the present disclosure.
Figure 7:
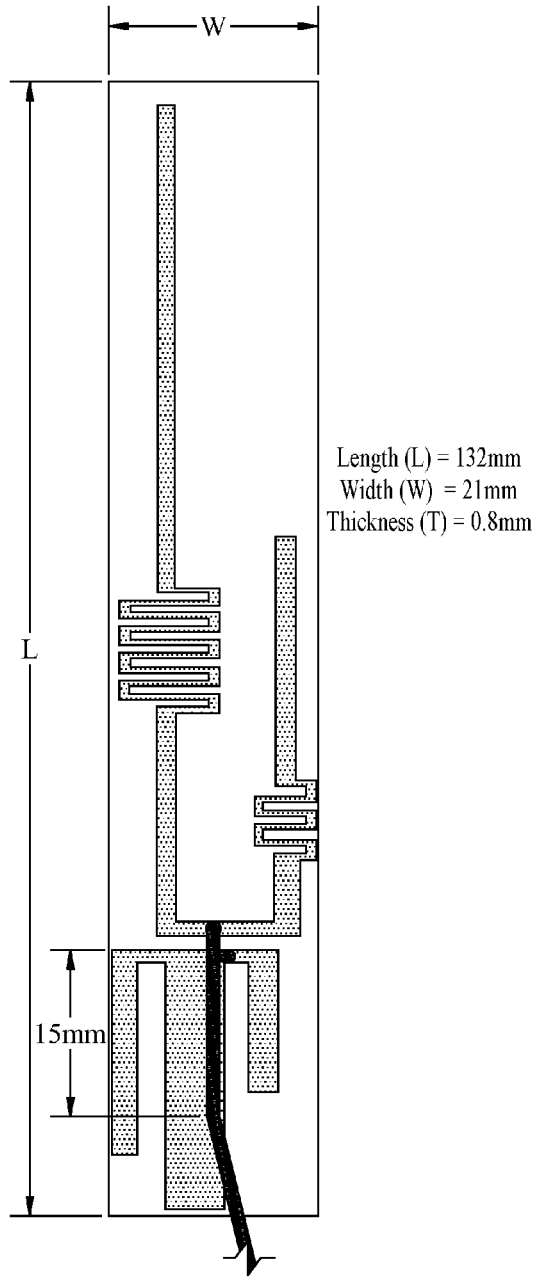
Figure 8:
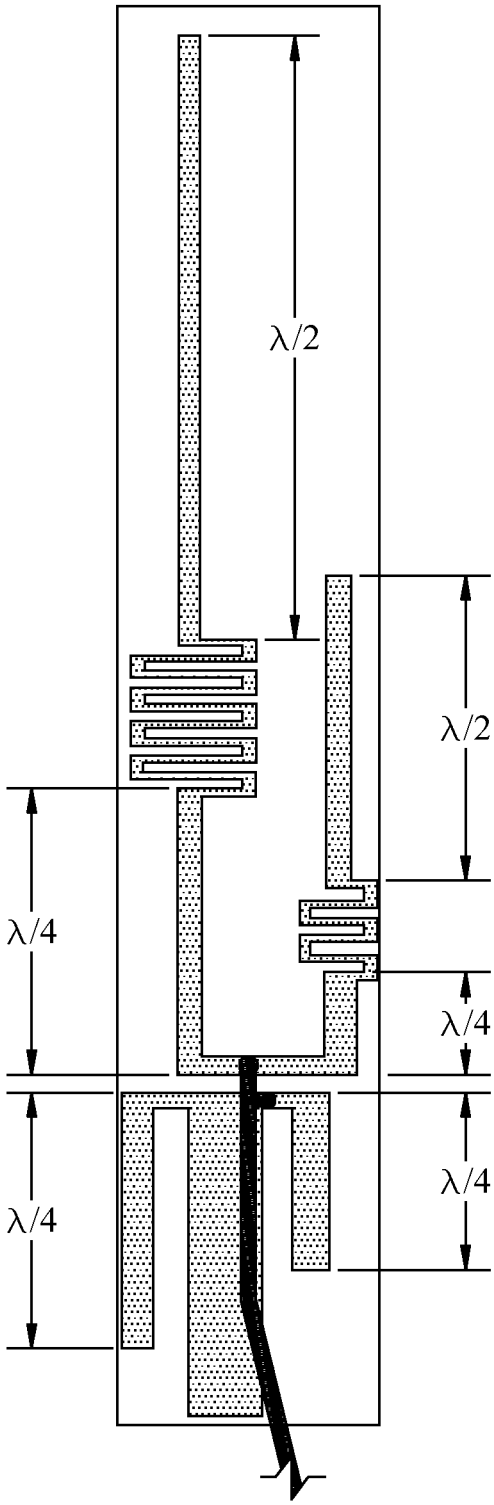
Figure 9:
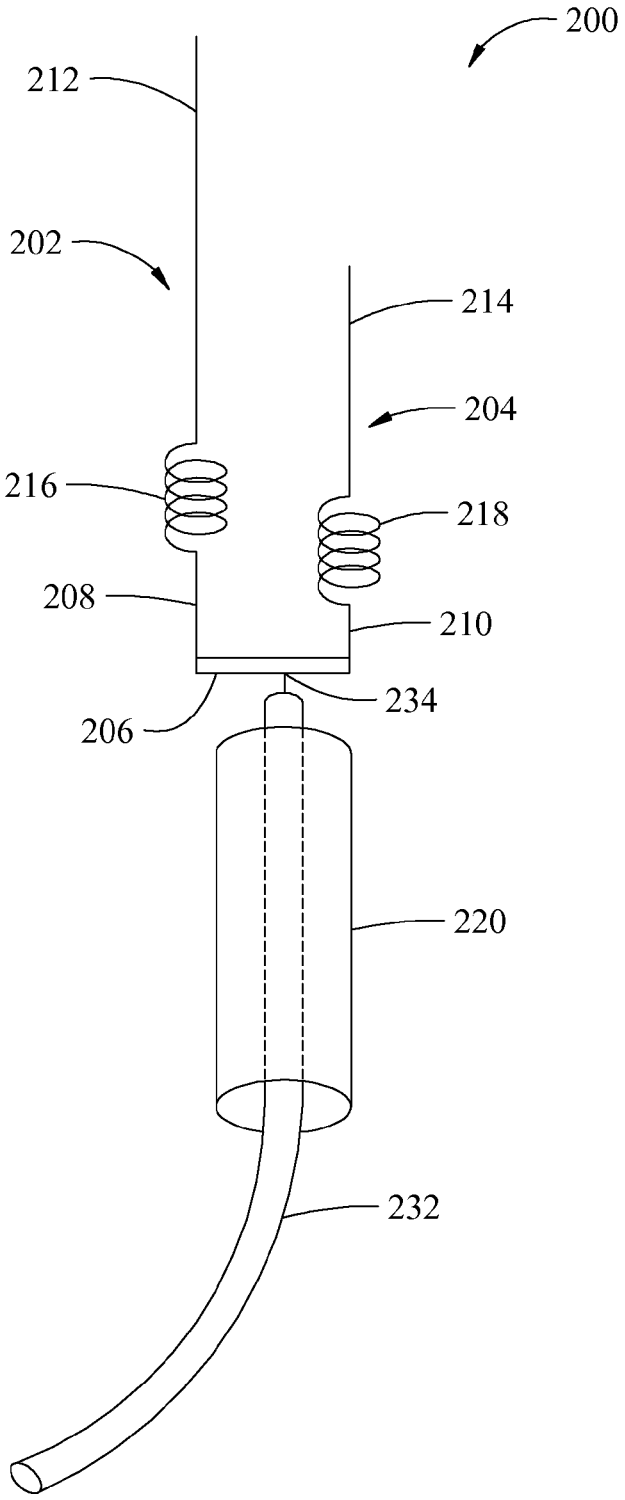

FIG. 7 is a view of the multiband high gain omnidirectional printed circuit board antenna with the coaxial cable conductor attached thereto shown in FIG. 1B with exemplary dimensions provided for purposes of illustration only according to exemplary embodiments; and FIG. 8 is a view of the multiband high gain omnidirectional printed circuit board antenna with the coaxial cable conductor attached thereto shown in FIG. 1B, and also illustrating the lengths ($\lambda/2$, $\lambda/4$) of various portions of the antenna with exemplary dimensions provided for purposes of illustration only according to exemplary embodiments; and FIG. 9 is a view of a multiband high gain omnidirectional antenna including copper wire radiating elements with helical portions, a tubular member or sleeve, and a coaxial cable attached thereto, according to an exemplary embodiment of the present disclosure.

DETAILED DESCRIPTION

Example embodiments will now be described more fully with reference to the accompanying drawings.

According to aspects of the present disclosure, antennas disclosed herein have a higher gain omnidirectional in multiband (e.g., a first frequency bandwidth of 2.4 gigahertz to 2.5 gigahertz and a second frequency bandwidth of 4.9 gigahertz to 5.875 gigahertz). A general rule of thumb is that the collinear array can achieve a gain of between about 5 dBi to about 6 dBi. Exemplary embodiments disclosed herein include antennas that can operate over more frequency bands and have higher gain.

FIG. 1A illustrates a multiband omnidirectional high gain antenna 100 embodying one or more aspects of the present disclosure. As shown, the antenna 100 includes radiating elements 102, 104 and a connecting element 106 connecting the radiating elements 102, 104. The radiating element 102 is configured to produce a first radiation pattern at a first frequency (e.g., a frequency within a first frequency bandwidth of 2.4 gigahertz to 2.5 gigahertz), while the radiating element 104 is configured to produce a second radiation pattern at a second frequency (e.g., a frequency within a second frequency bandwidth of 4.9 gigahertz to 5.875 gigahertz). The first radiating element 102 includes first and second straight portions 108, 112 (which may also be referred to as lower and upper radiating elements, respectively) with a bending or meandering portion 116 therebetween. The second radiating element 104 includes first and second straight portions 110, 114 (which may also be referred to as lower and upper radiating elements, respectively) with a bending or meandering portion 118 therebetween. In this particular example, each radiating element 102, 104 includes two straight portions with a meandering portion therebetween. The meandering portion 116 of the first radiating element 102 includes nine bending points 117, while the meandering portion 118 of the second radiating element 104 includes five bending points 119. During operation, the meandering portions 116 and 118 may be operable for phase reversal and matching. In turn, the matching and phase reversal between the radiating elements provided by the meandering portions 116 and 118 may allow the antenna 100 to be operated without requiring a matching circuit and/or to achieve higher gain performance. Alternative embodiments may include one or more radiating elements having more or less than two straight portions, more than one meandering portion, and/or a meandering portion configured differently (e.g., slanted portions, zigzags, etc.) with more or less bending points than what is shown in FIG. 1.

Figure 6:
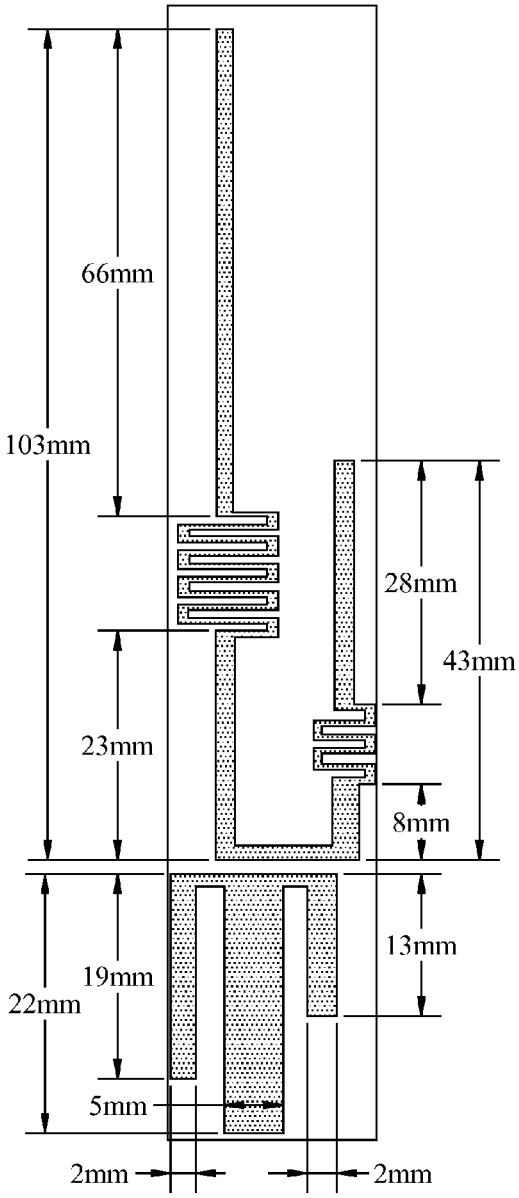
FIG. 6 is a view of the multiband high gain omnidirectional printed circuit board antenna shown in FIG. 1 with exemplary dimensions provided for purposes of illustration only according to exemplary embodiments.

With continued reference to FIG. 1A, the antenna 100 also includes power dissipation elements 122, 124, 126. The power dissipation elements 122, 124, 126 reduce the impact of a power feed on the first radiation pattern and the second radiation pattern. Power dissipation elements 122, 124, 126 may have identical lengths and/or widths, or they may have varied lengths and/or widths as shown in FIG. 1A. For example, FIG. 6 illustrates exemplary dimensions in millimeters of the lengths and widths of the power dissipation elements 122, 124, 126 according to an exemplary embodiment, where these dimensions are provided for purposes of illustration only and not for purposes of limitation. As shown in FIG. 6, the power dissipation elements 122, 124, 126 (FIG. 1A) may have respective lengths of about 19 millimeters, 22 millimeters, and 13 millimeters and respective widths of about 2 millimeters, 5 millimeters, and 2 millimeters. With reference to FIGS. 1 and 8, the power dissipation elements 122 and 126 (FIG. 1) may each have a length (as shown in FIG. 8) of $\lambda/4$. In this example, the power dissipation element 122 may have a length of $\lambda/4$ where $\lambda$ is the wavelength of the first signal at the first operating frequency, such as within the frequency bandwidth of 2.4 gigahertz to 2.5 gigahertz, while the power dissipation element 126 may have a length of length of $\lambda/4$ where $\lambda$ is the wavelength of a second signal at the second operating frequency, such as within the frequency bandwidth of 4.9 gigahertz to 5.875 gigahertz. While three power dissipation elements are shown in FIG. 1A, other embodiments may include more or less than three power dissipation elements and/or dissipation elements having a different configuration (e.g., shapes, sizes, locations, etc.).

As also shown in FIG. 1A, the antenna 100 includes a substrate 120 that supports the radiating elements 102, 104 on a same, single side of the substrate 120. For descriptive purposes, the substrate 120 may be considered as having a radiation portion 128 and a power feed portion 130. The first and second radiating elements 102, 104 are located in the radiation portion 128, such that the first and second radiating elements 102, 104 are laterally spaced apart from each other on the board 120. The first and second radiating elements 102, 104 extend generally perpendicular in a same direction (upward in FIG. 1A) from the connecting element 106. The power dissipation elements 122, 124, 126 are located in the power feed portion 128. The substrate 120 may be made from a number of different materials. In various exemplary embodiments, the substrate 120 comprises a flex material or dielectric or electrically non-conductive printed circuit board material. In embodiments in which the substrate 120 is formed from a relatively flexible material, the antenna 100 may be flexed or configured so as to follow the contour or shape of the antenna housing profile. For example, having a flexible substrate 120 may allow the antenna 100 to be flexed or configured into a generally cylindrical shape (or at least a portion thereof) so as to follow the contour or shape of a cylindrical antenna housing in which the antenna 100 may be housed. The substrate 120 may be formed from a material having low loss and dielectric properties. According to some embodiments the substrate 120 is a printed circuit board. In such embodiments, the radiating elements 102, 104 may be traces on the printed circuit board. The substrate 120 may be sized differently depending, for example, on the particular application as varying the thickness and dielectric constant of the substrate may be used to tune the frequencies. For example, FIG. 7 illustrates exemplary dimensions in millimeters of the substrate 120 according to an exemplary embodiment, where these dimensions are provided for purposes of illustration only and not for purposes of limitation. As shown in FIG. 7, the substrate 120 may have a length of about 132 millimeters, a width of about 21 millimeters, and a thickness of about 0.80 millimeters. Alternative embodiments may include a substrate with a different configuration (e.g., different shape, size, material, etc.). Still other embodiments may not include a printed circuit board substrate, such as the antenna 200 shown in FIG. 9 and described below.

In exemplary embodiments, the radiating elements 102, 104 may have lengths as shown in FIGS. 6, 7, and/or 8. In this regard, FIGS. 6, 7, and 8 illustrate exemplary dimensions of the radiating elements 102, 104 according to exemplary embodiments, where these dimensions are provided for purposes of illustration only and not for purposes of limitation. As shown in FIG. 6, the radiating elements 102, 104 may have respective lengths of 103 millimeters and 43 millimeters. Also shown in FIG. 6, the first radiating element's first and second straight portions 108, 112 may have respective lengths of about 23 millimeters and 66 millimeters, while the second radiating element's first and second straight portions 110, 114 may have respective lengths of about 8 millimeters and 23 millimeters. With reference to FIGS. 1 and 8, the first radiating element's first and second straight portions 108, 112 (FIG. 1) may be configured to be λ/4 and λ/2 radiating elements (as shown in FIG. 8) where λ is the wavelength of a first signal at the first operating frequency, such as within the frequency bandwidth of 2.4 gigahertz to 2.5 gigahertz. The second radiating element's first and second straight portions 110, 114 (FIG. 1) may be configured to be λ/4 and λ/2 radiating elements (as shown in FIG. 8) where λ is the wavelength of a second signal at the second operating frequency, such as within the frequency bandwidth of 4.9 gigahertz to 5.875 gigahertz. As one of ordinary skill in the art will recognize on reading this disclosure, the operating bands may be tuned by varying the length of radiating element 102 (and the lengths of its first and/or second straight portions 108, 112), the length of radiating element 104 (and the lengths of its first and/or second straight portions 110, 114), or a combination thereof. While two radiating elements 102 and 104 are shown, more or less than two radiating elements are possible. Varying the thickness and dielectric constant of the substrate may also be used to tune the frequencies.

Radiating elements 102, 104, and power dissipation elements 122, 124, 126 may be made of metallic material, such as, for example, copper, silver, gold, alloys, combinations thereof, other electrically-conductive materials, etc. Further, radiating elements 102, 104, and power dissipation elements 122, 124, and 126 may be made out of the same or different materials. Still further, radiating element 102 may be made of a different material than the material from which the radiating element 104 is formed. Similarly, power dissipation elements 122, 124, 126 may each be made out of the same material, different material, or some combination thereof.

FIG. 1B illustrates the antenna 100 with a power feed 132 attached thereto. The power feed 132 supplies power to the antenna 100. In the example shown in FIG. 1B, the power feed 132 is a coaxial cable conductor. Alternative embodiments however, may include any other suitable type of power feed structure as is known in the art.

With continued reference to FIG. 1B, the power feed 132 has a center conductor 134 and an outer jacket 136. The center conductor 134 is attached to the connecting element 106 to supply power to radiating elements 102, 104. The outer jacket 136 is coupled to the power dissipation elements 122, 124, 126 to dissipate power from the outer jacket 136. Optionally, the power feed 132 may be attached to the length of the power dissipation element 124 or directly to the substrate 120, for example, to provide additional strength and/or reinforcement to the power feed 132. Generally, the connections may be accomplished using solder connections, but other types of connections are possible, such as, for example, snap connectors, press fit connections, or the like.

Figures 2A, 2B:
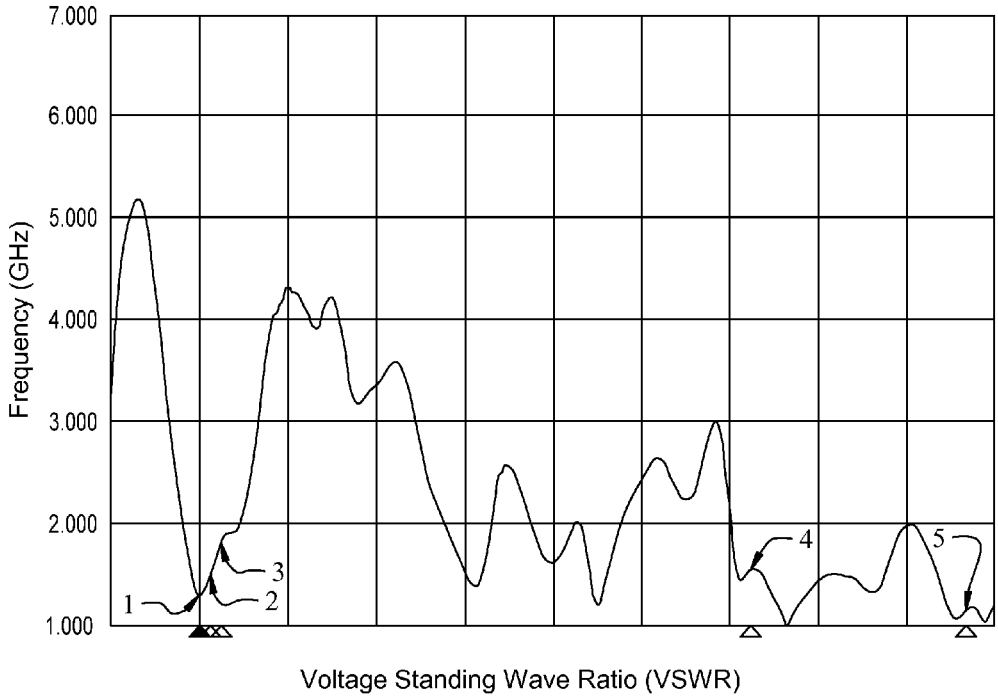
FIG. 2A is an exemplary line graph of voltage standing wave ratio (VSWR) versus frequency from 2 gigahertz to 6 gigahertz for the exemplary antenna shown in FIG. 1B.
FIG. 2B is a table setting forth the VSWR and frequency (in Gigahertz) for the five data points shown in the line graph of FIG. 2A.

FIG. 2A is an exemplary line graph of voltage standing wave ratio (VSWR) versus frequency from 2 gigahertz to 6 gigahertz for the exemplary antenna 100 shown in FIG. 1A. The data depicted in the line graph (FIG. 2A) generally demonstrates that the performance of the antenna 100 is relatively good and well matched. The performance will depend, at least in part, on the PCB material. In regard to the data shown in FIG. 2A, the PCB material was Rogers.

FIG. 2B is a table of VSWR at specific data points, i.e. specific frequencies, derived from the graph of FIG. 2A. By way of background, VSWR may be used to indicate reception quality of an antenna. The VSWR indicates interference caused by reflected waves and may serve as an indicator of reflected waves bouncing back and forth within a transmission line of the assembly. In theory, a 1:1 VSWR represents a perfect match of antenna components. But in practice, a 2:1 VSWR is typically acceptable. Higher VSWR may indicate a degradation of signal reception by an antenna assembly.

Figure 3:
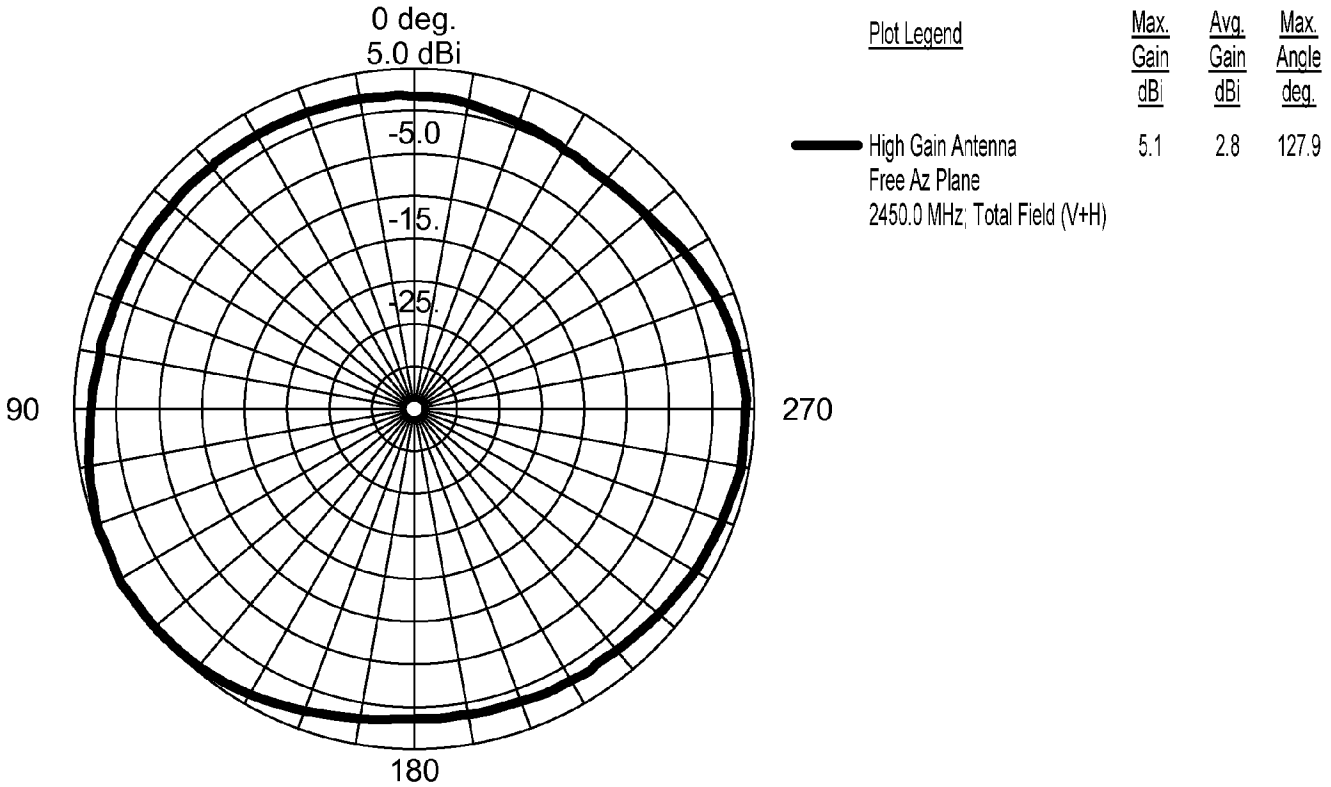
FIG. 3 is an exemplary radiation pattern illustrating gain (in decibels referenced to isotropic gain (dBi)) for the exemplary antenna shown in FIG. 1B at a frequency of 2.45 Gigahertz.

FIG. 3 is an exemplary radiation pattern illustrating gain (in decibels referenced to isotropic gain (dBi)) for the exemplary antenna 100 shown in FIG. 1A at a frequency of 2.45 Gigahertz. In this example, the antenna 100 had a maximum or peak gain of about 5.1 dBi, an average gain of about 2.8 dBi, and a maximum angle of about 127.9 degrees. The data depicted in the FIG. 3 generally demonstrates that the antenna 100 achieved higher peak gain with omnidirectional at 2.45 GHz and smaller physical size. The performance will depend, at least in part, on the PCB material. In regard to the data shown in FIG. 3, the PCB material was Rogers. With continued reference to FIG. 3, "Free Az" refers to the measurements of the antenna in free space and the position is Azimuth, whereas "Total Field (V+H)" refers to the field of Vertical Polarization and Horizontal Polarization.

Figure 4:
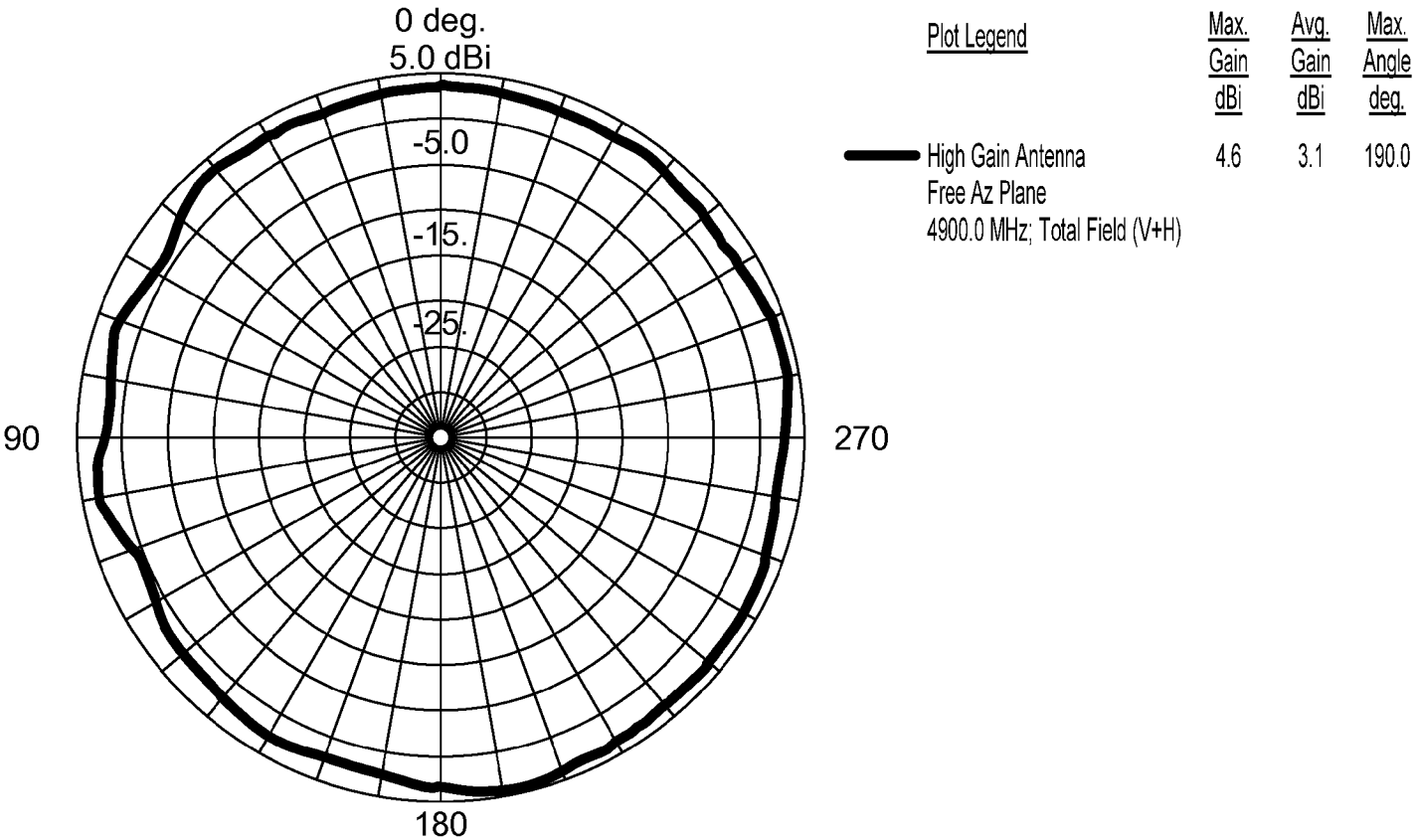
FIG. 4 is an exemplary radiation pattern illustrating gain (in decibels referenced to isotropic gain (dBi)) for the exemplary antenna shown in FIG. 1B at a frequency of 4.9 Gigahertz.

FIG. 4 is an exemplary radiation pattern illustrating gain (in decibels referenced to isotropic gain (dBi)) for the exemplary antenna 100 shown in FIG. 1A at a frequency of 4.9 Gigahertz. In this example, the antenna 100 had a maximum or peak gain of about 4.6 dBi, an average gain of about 3.1 dBi, and a maximum angle of about 190.0 degrees. The data depicted in the FIG. 4 generally demonstrates that the antenna 100 achieved higher peak gain with omnidirectional at 4.9 GHz and smaller physical size. The performance will depend, at least in part, on the PCB material. In regard to the data shown in FIG. 4, the PCB material was Rogers.

Figure 5:
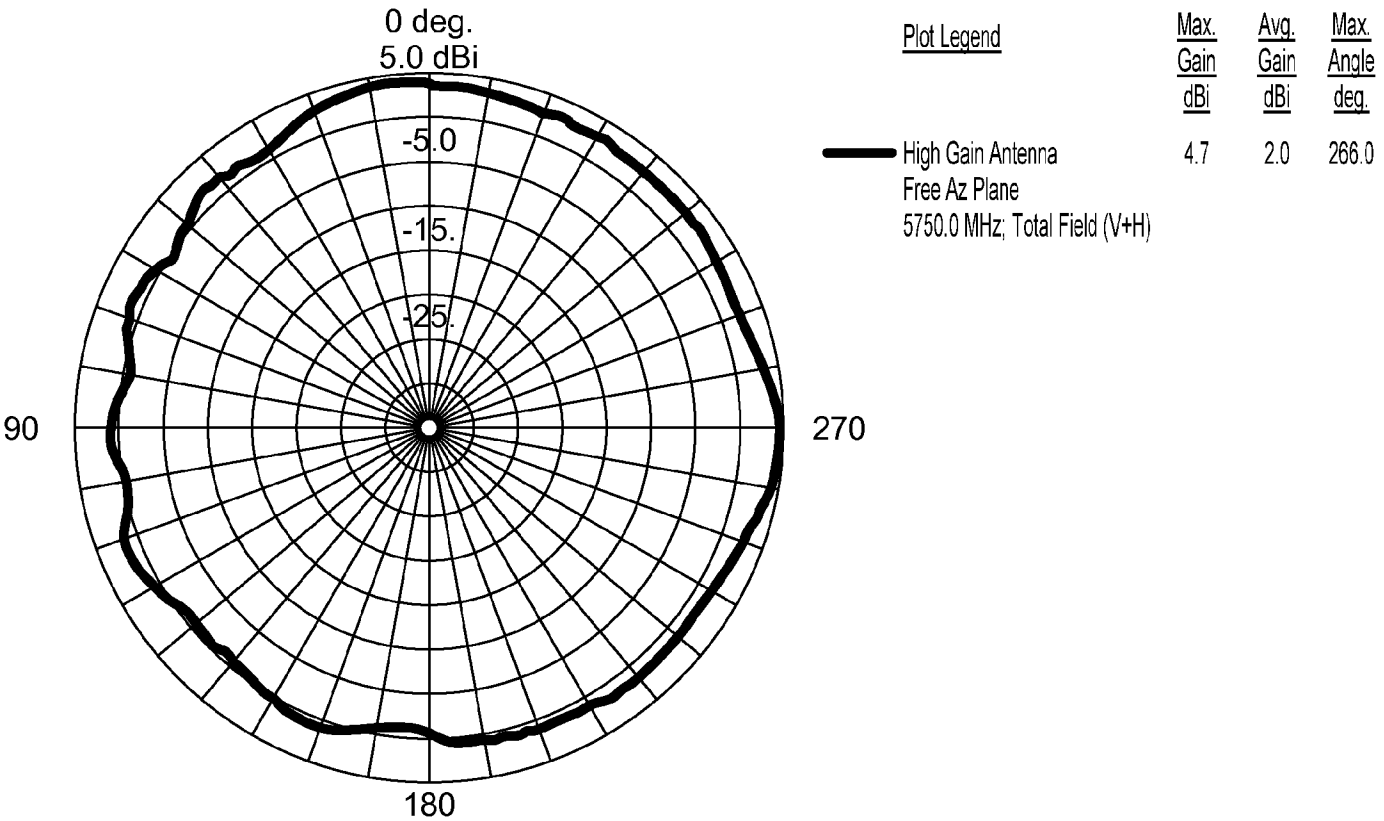
FIG. 5 is an exemplary radiation pattern illustrating gain (in decibels referenced to isotropic gain (dBi)) for the exemplary antenna shown in FIG. 1B at a frequency of 5.75 Gigahertz.

FIG. 5 is an exemplary radiation pattern illustrating gain (in decibels referenced to isotropic gain (dBi)) for the exemplary antenna 100 shown in FIG. 1A at a frequency of 5.75 Gigahertz. In this example, the antenna 100 had a maximum or peak gain of about 4.7 dBi, an average gain of about 2.0 dBi, and a maximum angle of about 266.0 degrees. The data depicted in the FIG. 5 generally demonstrates that the antenna 100 achieved higher peak gain with omnidirectional at 5.75 GHz and smaller physical size. The performance will depend, at least in part, on the PCB material. In regard to the data shown in FIG. 5, the PCB material was Rogers.

FIGS. 6 and 7 illustrate exemplary dimensions in millimeters that may be used for the antenna 100 shown in FIGS. 1A and 1B, respectively, for purposes of illustration only and not for purposes of limitation. In the particular embodiment shown in FIGS. 6 and 7, the PCB is a Rogers PCB. The materials and dimensions provided herein are for purposes of illustration only as a contact may be configured from different materials and/or with different dimensions. For example, the dimensions may slightly change depending on which materials are selected for the various components of the antenna, the dielectric constant of the PCB, the coaxial cable length, etc.

FIG. 8 is a view of the antenna 100 shown in FIG. 1B, and also illustrating the lengths (λ/2, λ/4) of various portions of the antenna with exemplary dimensions provided for purposes of illustration according to exemplary embodiments. With continued reference to FIG. 8, a general rule of thumb is that the collinear array has λ/2, λ/4 and phase reversal or matching (e.g., via meander sections 116, 118 in FIG. 1B), but other embodiments may include dimensions that may slightly change due to the selection of materials, dielectric constant of PCB, cable length, etc.

FIG. 9 illustrates an alternative embodiment of a multiband high gain omnidirectional antenna 200 embodying one or more aspects of the present disclosure. As shown in FIG. 9, the antenna 200 includes radiating elements 202, 204 and a connecting element 206 connecting the radiating elements 202, 204. In this example, the radiating elements 202, 204 may be formed from an electrically-conductive material, such as copper wire, etc. By way of comparison, the radiating elements 102, 104 of antenna 100 shown in FIGS. 1A and 1B may be traces on a printed circuit board.

With continued reference to FIG. 9, the antenna 200 includes an electrically-conductive tubular member 220, which is shown as a metal tube or sleeve in this example. The radiating elements 202, 204 and tubular member 220 may be made of metallic material, such as, for example, copper, silver, gold, alloys, combinations thereof, other electrically-conductive materials, etc. Further, the radiating elements 202, 204 and tube 220 may be made out of the same or different materials. Still further, the radiating element 202 may be made of a different material than the material from which the radiating element 204 is formed.

The antenna 200 includes a power feed 232 that supplies power to the antenna 200. In the example shown in FIG. 9, the power feed 232 is a coaxial cable conductor that extends or passes through the electrically-conductive tubular member 220. The power feed 232 has a center conductor 234 attached to the connecting element 206 to supply power to radiating elements 202, 204. The outer portion or jacket (e.g., metallic braid) of the power feed 232 may be coupled to the electrically-conductive tubular member 220 to dissipate power from the outer jacket of the power feed. Generally, the connections may be accomplished using solder connections, but other types of connections are possible, such as, for example, snap connectors, press fit connections, crimping, or the like. By way of example, the outer portion of the power feed 232 may be coupled to the sleeve 220 by way of soldering or a crimping process. The sleeve 220 acts as the ground of the antenna 200 with the length of quarter wavelength of the low operating frequency band (e.g., a first frequency bandwidth of 2.4 gigahertz to 2.5 gigahertz). Accordingly, this exemplary antenna 200 may thus generally have a dipole design and be ground independent. Alternative embodiments however, may include any other suitable type of power feed and grounding structures known in the art.

The radiating element 202 is configured to produce a first radiation pattern at a first frequency (e.g., a frequency within a first frequency bandwidth of 2.4 gigahertz to 2.5 gigahertz), while the radiating element 204 is configured to produce a second radiation pattern at a second frequency (e.g., a frequency within a second frequency bandwidth of 4.9 gigahertz to 5.875 gigahertz). The first radiating element 202 includes first and second straight portions 208, 212 with a helical or coiled portion 216 therebetween. The second radiating element 204 includes first and second straight portions 210, 214 with a helical or coiled portion 218 therebetween. In this particular example, each radiating element 202, 204 includes two straight portions with a helical portion therebetween. During operation, the coils of the helical portions 216 and 218 may be operable for phase reversal and matching. In turn, the matching and phase reversal between the radiating elements provided by the coil portions 216 and 218 may allow the antenna 200 to be operated without requiring a matching circuit and/or to achieve higher gain performance. Alternative embodiments may include one or more radiating elements having more or less than two straight portions, more than one helical portion, and/or a helical portion configured differently than what is shown in FIG. 9.

In exemplary embodiments, the radiating elements 202, 204 may have respective lengths of 103 millimeters and 43 millimeters. As an example, the first radiating element 202 may include first and second straight portions 208, 212 having respective lengths of $\lambda/4$ and $\lambda/2$ where $\lambda$ is the wavelength of a first signal at the first operating frequency, such as within the frequency bandwidth of 2.4 gigahertz to 2.5 gigahertz. Continuing with this example, the second radiating element 204 may include first and second straight portions 210, 214 having respective lengths of $\lambda/4$ and $\lambda/2$ where $\lambda$ is the wavelength of a second signal at the second operating frequency, such as within the frequency bandwidth of 4.9 gigahertz to 5.875 gigahertz. The operating bands may be tuned by varying the length of radiating element 202, the length of radiating element 204, or a combination thereof. While two radiating elements are shown, more or less than two radiating elements are possible.

According to aspects of the present disclosure, exemplary embodiments disclosed herein may have a dipole design and be configured to be ground independent. Such exemplary antennas may be configured with radio frequency (RF) connectors and coaxial feeding without requiring a separate matching circuit. Exemplary antennas may include meandering portions (e.g., 116, 118, etc.) or coiled portions (e.g., 216, 218, etc.) that may be operable for phase reversal for two radiating elements to achieve high gain performance.

Various antennas (e.g., antenna 100 (FIGS. 1 and 2), antennas shown in FIGS. 6, 7, 8, antenna 200 (FIG. 9), etc.) disclosed herein may be integrated in, embedded in, installed to, mounted on, externally mounted or supported on a portable terminal or wireless application device, including, for example, a personal computer, a cellular phone, personal digital assistant (PDA), etc. within the scope of the present disclosure. For example, an antenna may be used as an external antenna. I such embodiments, the antenna may be mounted in its own housing, and a coaxial cable may be terminated with a connector (e.g., SMA (SubMiniature Type A) connector, MMCX (micro-miniature coaxial) connector, MCC or mini coaxial connector, U.FL connector, etc.) for connecting to an external antenna connector of a wireless communication device, portable terminal, or application device, such as a desktop computer, laptop computer, etc.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter. The disclosure of a first value and a second value for a given parameter can be interpreted as disclosing that any value between the first and second values could also be employed for the given parameter. Similarly, it is envisioned that disclosure of two or more ranges of values for a parameter (whether such ranges are nested, overlapping or distinct) subsume all possible combination of ranges for the value that might be claimed using endpoints of the disclosed ranges.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A multiband high gain omnidirectional antenna comprising:

a first radiating element including at least two generally straight portions and at least one meandering portion generally between the at least two straight portions, and configured to produce a first radiation pattern at a first operating frequency;

a second radiating element including at least two generally straight portions and at least one meandering portion generally between the at least two straight portions, and configured to produce a second radiation pattern at a second operating frequency; and a connecting element connected to at least one straight portion of each of the first and second radiating elements, thereby connecting the first radiating element and the second radiating element;

the first and second radiating elements laterally spaced apart and extending generally perpendicular in a same direction from the connecting element;

wherein:

the antenna further comprises a printed circuit board, and wherein the first radiating element, the second radiating element, and the connecting element comprise at least one trace on the printed circuit board; and/or the meandering portion of the first radiating element includes nine bending points; and the meandering portion of the second radiating element includes five bending points.

2. A multiband high gain omnidirectional antenna comprising:

a first radiating element including at least two generally straight portions and at least one meandering portion generally between the at least two straight portions, and configured to produce a first radiation pattern at a first operating frequency;

a second radiating element including at least two generally straight portions and at least one meandering portion generally between the at least two straight portions, and configured to produce a second radiation pattern at a second operating frequency; and a connecting element connected to at least one straight portion of each of the first and second radiating elements, thereby connecting the first radiating element and the second radiating element;

the first and second radiating elements laterally spaced apart and extending generally perpendicular in a same direction from the connecting element;

wherein:

the at least two generally straight portions of the first radiating element include a $\lambda/4$ radiating portion between the at least one meandering portion and the connecting portion, and a $\lambda/2$ radiating portion disposed on a side of the at least one meandering portion opposite that of the $\lambda/4$ radiating portion, where $\lambda$ is a wavelength of a first signal at the first operating frequency; and the at least two generally straight portions of the second radiating element include a $\lambda/4$ radiating portion between the at least one meandering portion and the connecting portion, and a $\lambda/2$ radiating portion disposed on a side of the at least one meandering portion opposite that of the λ/4 radiating portion, where λ is a wavelength of a second signal at the second operating frequency.

3. The antenna of claim 1, further comprising:

at least one power dissipation element;

a power feed coupled to the first radiating element and the second radiating element; and a ground coupled to the at least one power dissipation element.

4. A multiband high gain omnidirectional antenna comprising:

a first radiating element including at least two generally straight portions and at least one meandering portion generally between the at least two straight portions, and configured to produce a first radiation pattern at a first operating frequency;

a second radiating element including at least two generally straight portions and at least one meandering portion generally between the at least two straight portions, and configured to produce a second radiation pattern at a second operating frequency;

a connecting element connected to at least one straight portion of each of the first and second radiating elements, thereby connecting the first radiating element and the second radiating element;

at least one power dissipation element;

a power feed coupled to the first radiating element and the second radiating element; and a ground coupled to the at least one power dissipation element the first and second radiating elements laterally spaced apart and extending generally perpendicular in a same direction from the connecting element;

wherein:

the power feed comprises at least one coaxial cable; and/or the at least one power dissipation element comprises first, second, and third power dissipation elements, and the second power dissipation element is disposed generally between the first and third power dissipation elements.

5. A multiband high gain omnidirectional antenna comprising:

a first radiating element including at least two generally straight portions and at least one meandering portion generally between the at least two straight portions, and configured to produce a first radiation pattern at a first operating frequency;

a second radiating element including at least two generally straight portions and at least one meandering portion generally between the at least two straight portions, and configured to produce a second radiation pattern at a second operating frequency;

a connecting element connected to at least one straight portion of each of the first and second radiating elements, thereby connecting the first radiating element and the second radiating element;

at least one λ/4 power dissipation element where λ is a wavelength of a first signal at the first operating frequency; and at least one other λ/4 power dissipation element where λ is a wavelength of a second signal at the second operating frequency;

the first and second radiating elements laterally spaced apart and extending generally perpendicular in a same direction from the connecting element.

6. The antenna of claim 1, wherein the meandering portions are configured to be operable for phase reversal and matching.

7. A multiband high gain omnidirectional antenna comprising:

a first radiating element including at least two generally straight portions and at least one meandering portion generally between the at least two straight portions, and configured to produce a first radiation pattern at a first operating frequency;

a second radiating element including at least two generally straight portions and at least one meandering portion generally between the at least two straight portions, and configured to produce a second radiation pattern at a second operating frequency; and a connecting element connected to at least one straight portion of each of the first and second radiating elements, thereby connecting the first radiating element and the second radiating element;

the first and second radiating elements laterally spaced apart and extending generally perpendicular in a same direction from the connecting element;

wherein:

the first operating frequency is between about 2.4 gigahertz and about 2.5 gigahertz; and/or the second operating frequency is between about 4.9 gigahertz and about 5.875 gigahertz; and/or whereby the antenna is operable such that peak gain is between about 4.6 dBi and 6 dBi for the first and second operating frequencies and/or voltage standing wave ratio is less than about 2:1 for the first and second operating frequencies.

8. A multiband high gain omnidirectional antenna comprising:

a first radiating element including at least two generally straight portions and at least one meandering portion generally between the at least two straight portions, and configured to produce a first radiation pattern at a first operating frequency;

a second radiating element including at least two generally straight portions and at least one meandering portion generally between the at least two straight portions, and configured to produce a second radiation pattern at a second operating frequency; and a connecting element connected to at least one straight portion of each of the first and second radiating elements, thereby connecting the first radiating element and the second radiating element;

the first and second radiating elements laterally spaced apart and extending generally perpendicular in a same direction from the connecting element;

wherein the first and second radiating elements comprise electrically-conductive wires including the at least two generally straight portions and at least one meandering portion, wherein the electrically-conductive wires include helical portions defining the meandering portions.

9. The antenna of claim 8, further comprising an electrically-conductive tubular member and a coaxial cable coupled to the electrically-conductive tubular member, whereby the electrically-conductive tubular member is operable for grounding the antenna.

10. A multiband high gain omnidirectional antenna comprising:

a first radiating element operable for producing a first radiation pattern at a first operating frequency, the first radiating element including at least one meandering portion disposed between a λ/4 radiating portion and a λ/2 radiating portion, where λ is a wavelength of a first signal at the first operating frequency; and a second radiating element operable for producing a second radiation pattern at a second operating frequency, the second radiating element including at least one meandering portion disposed between a λ/4 radiating portion and a λ/2 radiating portion, where λ is a wavelength of a second signal at the second operating frequency.

11. The antenna of claim 10, further comprising a connecting element connected to the λ/4 radiating portions of the first and second radiating elements, and wherein the first and second radiating elements are laterally spaced apart and extend generally perpendicular in a same direction from the connecting element.

12. The antenna of claim 10, wherein the meandering portions are configured to be operable for phase reversal and matching.

13. The antenna of claim 10, further comprising:

at least one power dissipation element;

a power feed coupled to the first radiating element and the second radiating element; and a ground coupled to the at least one power dissipation element.

14. The antenna of claim 13, wherein:

the power feed comprises at least one coaxial cable; and/or the at least one power dissipation element comprises three power dissipation elements of different lengths.

15. The antenna of claim 10, further comprising:

at least one λ/4 power dissipation element where λ is a wavelength of a first signal at the first operating frequency; and at least one λ/4 power dissipation element where λ is a wavelength of a second signal at the second operating frequency.

16. The antenna of claim 10, wherein:

the antenna further comprises a printed circuit board, and wherein the first radiating element, the second radiating element, and the connecting element comprise at least one trace on the printed circuit board; and/or the meandering portion of the first radiating element includes nine bending points; and the meandering portion of the second radiating element includes five bending points.

17. The antenna of claim 10, wherein:

the first operating frequency is between about 2.4 gigahertz and about 2.5 gigahertz; and/or the second operating frequency is between about 4.9 gigahertz and about 5.875 gigahertz; and/or whereby the antenna is operable such that peak gain is between about 4.6 dBi and 6 dBi for the first and second operating frequencies and/or voltage standing wave ratio is less than about 2:1 for the first and second operating frequencies.

18. The antenna of claim 10, wherein the first and second radiating elements comprise electrically-conductive wires including the at least two generally straight portions and at least one meandering portion, wherein the electrically-conductive wires include helical portions defining the meandering portions.

19. The antenna of claim 18, further comprising an electrically-conductive tubular member and a coaxial cable coupled to the electrically-conductive tubular member, whereby the electrically-conductive tubular member is operable for grounding the antenna.

20. A multiband high gain omnidirectional antenna comprising:

a first radiating element comprising electrically-conductive wire and operable for producing a first radiation pattern at a first operating frequency, the first radiating element including at least one helical portion disposed between a λ/4 radiating portion and a λ/2 radiating portion, where λ is a wavelength of a first signal at the first operating frequency;

a second radiating element comprising electrically-conductive wire and operable for producing a second radiation pattern at a second operating frequency, the second radiating element including at least one helical portion disposed between a λ/4 radiating portion and a λ/2 radiating portion, where λ is a wavelength of a second signal at the second operating frequency;

a connecting element connected to the λ/4 radiating portions of the first and second radiating elements, the first and second radiating elements laterally spaced apart and extending generally perpendicular in a same direction from the connecting element.

21. The antenna of claim 20, further comprising:

an electrically-conductive tubular member; and a coaxial cable coupled to the electrically-conductive tubular member.

22. The antenna of claim 20, wherein:

the first operating frequency is between about 2.4 gigahertz and about 2.5 gigahertz; and/or the second operating frequency is between about 4.9 gigahertz and about 5.875 gigahertz; and/or whereby the antenna is operable such that peak gain is between about 4.6 dBi and 6 dBi for the first and second operating frequencies and/or voltage standing wave ratio is less than about 2:1 for the first and second operating frequencies.

* * * * *